US008677737B2

(12) United States Patent
Kamiya et al.

(10) Patent No.: US 8,677,737 B2
(45) Date of Patent: Mar. 25, 2014

(54) ENGINE POWERED MACHINE

(75) Inventors: Shohei Kamiya, Tsuchiura (JP); Kazunori Nakamura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 159 days.

(21) Appl. No.: 12/667,612

(22) PCT Filed: Jul. 2, 2008

(86) PCT No.: PCT/JP2008/061995
§ 371 (c)(1),
(2), (4) Date: Jan. 4, 2010

(87) PCT Pub. No.: WO2009/005091
PCT Pub. Date: Jan. 8, 2009

(65) Prior Publication Data

US 2011/0011064 A1 Jan. 20, 2011

(30) Foreign Application Priority Data

Jul. 3, 2007 (JP) ..... 2007-175456

(51) Int. Cl.
*F01N 3/00* (2006.01)

(52) U.S. Cl.
USPC ..... 60/295; 60/303

(58) Field of Classification Search
USPC ..... 60/295, 274, 320, 303; 123/41.29
See application file for complete search history.

(56) References Cited

U.S. PATENT DOCUMENTS

| | | | | |
|---|---|---|---|---|
| 5,884,475 | A * | 3/1999 | Hofmann et al. | 60/274 |
| 7,849,674 | B2 * | 12/2010 | Masuda et al. | 60/286 |
| 7,895,829 | B2 * | 3/2011 | Suzuki et al. | 60/286 |
| 2006/0157000 | A1 * | 7/2006 | Lutze et al. | 123/41.02 |
| 2007/0180818 | A1 | 8/2007 | Masuda et al. | |

FOREIGN PATENT DOCUMENTS

| | | | |
|---|---|---|---|
| JP | 2004-301041 | A | 10/2004 |
| JP | 2005-90431 | A | 4/2005 |

OTHER PUBLICATIONS

International Search Report dated Sep. 30, 2008, including English translation (Two (2) pages).

* cited by examiner

*Primary Examiner* — Kenneth Bomberg
*Assistant Examiner* — Jason Sheppard
(74) *Attorney, Agent, or Firm* — Crowell & Moring LLP

(57) ABSTRACT

An engine powered machine is provided with a high-performance exhaust gas purification system and is capable of promptly raising a temperature of an operator's cab to a comfortable temperature. The exhaust gas purification system that makes use of an NOx removal catalyst and a reducing agent is provided with a reducing agent heater for heating a reducing agent, which is stored in a reducing agent tank, with heat of an engine cooling medium and an on/off device for controlling an introduction of the engine cooling medium into the reducing agent heater. When a temperature of the engine cooling medium is higher than a first predetermined temperature, a temperature of the reducing agent in the tank is lower than a second predetermined temperature and a temperature in an operator's cab is lower than a third predetermined temperature, a controller switches the on/off device into a closed state to increase a flow rate of the engine cooling medium to be guided to a heat exchanger of a heating apparatus.

1 Claim, 3 Drawing Sheets

ENGINE POWERED MACHINE

TECHNICAL FIELD

This invention relates to a machine equipped with an engine as a power source (engine powered machine) such as a construction machine or automotive vehicle, and especially to an engine powered machine provided with an exhaust gas purification system that purifies nitrogen oxides in exhaust gases by using an NOx removal catalyst and a reducing agent.

BACKGROUND ART

Known exhaust gas purification systems to be mounted on engine powered machines include one provided with an NOx removal catalyst arranged in an exhaust pipe and a reducing agent feeder for injecting a reducing agent, which is stored in a reducing agent tank, from a side upstream of the arranged location of the NOx removal catalyst to selectively subject nitrogen oxides in exhaust gases to reduction treatment with the reducing agent in the presence of the NOx removal catalyst such that the nitrogen oxides are decomposed into harmless nitrogen gas and water. Usable as the reducing agent is a urea water that undergoes hydrolysis in the exhaust pipe and is changed into ammonia having good reactivity with nitrogen oxides, an aqueous ammonia solution, gas oil containing hydrocarbons as principal components, or the like.

A reducing agent such as a urea water or aqueous ammonia solution freezes at low temperatures and produces ammonia gas having an offensive odor at high temperatures, and therefore, requires appropriate temperature control while being stored in a reducing agent tank. Conventionally-proposed means for maintaining a reducing agent, which is stored in a reducing agent tank, within an appropriate temperature range include the one which is provided with a reducing agent heater for introducing an engine cooling medium into the reducing agent tank to heat with heat of the engine cooling medium the reducing agent stored in the reducing agent tank and an on/off device for opening/closing a cooling medium flow passage that guides the engine cooling medium to the reducing agent heater, and which, when the reducing agent is in a frozen state, switches the on/off device into an open state to thaw the frozen reducing agent with heat of the engine cooling medium and, when the reducing agent has been heated to a predetermined temperature above a thaw temperature of the reducing agent, switches the on/off device into a closed state to cut off an inflow of thermal energy such that overheating of the reducing agent is prevented (see, for example, Patent Document 1).

Patent Document 1: JP-A-2005-90431

DISCLOSURE OF THE INVENTION

Problem to be Solved by the Invention

Engine powered machines having operator's cabs to permit their operation by operators sitting in the operator's cabs include those each provided with a heating apparatus for heating an interior of the operator's cab with the heat of an engine cooling medium to allow the operator to operate the engine powered machine in a comfortable operational environment even at a cold time. Application of an exhaust gas purification system of the above-described conventional example to such an engine powered machine provided with such a heating apparatus will, however, cause a discomfort to an operator for a long time because, when the on/off device is switched into the open state to guide the engine cooling medium into the reducing agent tank, the amount of the engine cooling medium to be guided to the heating apparatus relatively decreases, thereby making it difficult to promptly raise the temperature in the operator's cab to a comfortable temperature.

With a view to solving such a problem of the conventional technology, an object of the present invention is to provide an engine powered machine provided with a high-performance exhaust gas purification system and capable of promptly raising a temperature in an operator's cab to a comfortable temperature.

Means for Solving the Problem

To solve the above-described problem, the present invention has been constituted such that, in an engine powered machine provided with an NOx removal catalyst arranged in an exhaust passage of an engine to selectively subject to reduction treatment nitrogen oxides that flow through the exhaust passage, a reducing agent tank for storing a reducing agent, a reducing agent feeder for injecting into the exhaust passage the reducing agent stored in the reducing agent tank, a reducing agent temperature detector for detecting a temperature of the reducing agent stored in the reducing agent tank, a reducing agent heater for heating the reducing agent, which is stored in the reducing agent tank, with heat of an engine cooling medium, an on/off device for opening/closing a cooling medium flow passage that guides the engine cooling medium to the reducing agent heater, a cooling medium temperature detector for detecting a temperature of the engine cooling medium, a heating apparatus for heating an interior of an operator's cab with heat of the engine cooling medium, an operator's cab temperature detector for detecting a temperature in the operator's cab, and a controller for receiving detected temperature signals outputted from the respective temperature detectors and controlling drive of the reducing agent feeder, on/off device and heating apparatus, the controller switches the on/off device into a closed state to cut off an introduction of the engine cooling medium into the reducing agent heater to increase a flow rate of the engine cooling medium to be guided to the heating apparatus when the temperature of the engine cooling medium as detected by the cooling medium temperature detector is higher than a first predetermined temperature, the temperature of the reducing agent as detected by the reducing agent temperature detector is lower than a second predetermined temperature and the temperature in the operator's cab as detected by the operator's cab temperature detector is lower than a third predetermined temperature.

According to such a constitution, the operator's cab can be preferentially heated at a cold time, so that discomfort of an operator who is operating the engine powered machine can be promptly eliminated to improve the operator's comfort. After the temperature in the operator's cab has reached a predetermined temperature, the frozen reducing agent can be thawed with the heat of the engine cooling medium by switching the on/off device into an open state, thereby making it possible to perform purification of exhaust gases from the engine. After the temperature of the reducing agent has then reached a predetermined temperature above its thaw temperature, the heating of the reducing agent can be stopped by switching the on/off device into the closed state, thereby making it possible to prevent the production of an offensive odor.

Advantageous Effects of the Invention

The engine powered machine according to the present invention can preferentially heat the operator's cab at a cold time to improve the operator's comfort, because the on/off device is switched into the closed state to cut off the introduction of the engine cooling medium into the reducing agent heater to increase the flow rate of the engine cooling medium to be guided to the heating apparatus when the temperature of the engine cooling medium as detected by the cooling medium temperature detector is higher than the first predetermined temperature, the temperature of the reducing agent as detected by the reducing agent temperature detector is lower than the second predetermined temperature and the temperature in the operator's cab as detected by the operator's cab temperature detector is lower than the third predetermined temperature. Owing to the arrangement of the exhaust gas purification system having the means for maintaining the temperature of the reducing agent within an appropriate temperature range, it is possible to thaw the frozen reducing agent and also to prevent the production of an offensive odor from the reducing agent.

BEST MODES FOR CARRYING OUT THE INVENTION

Figure 1:
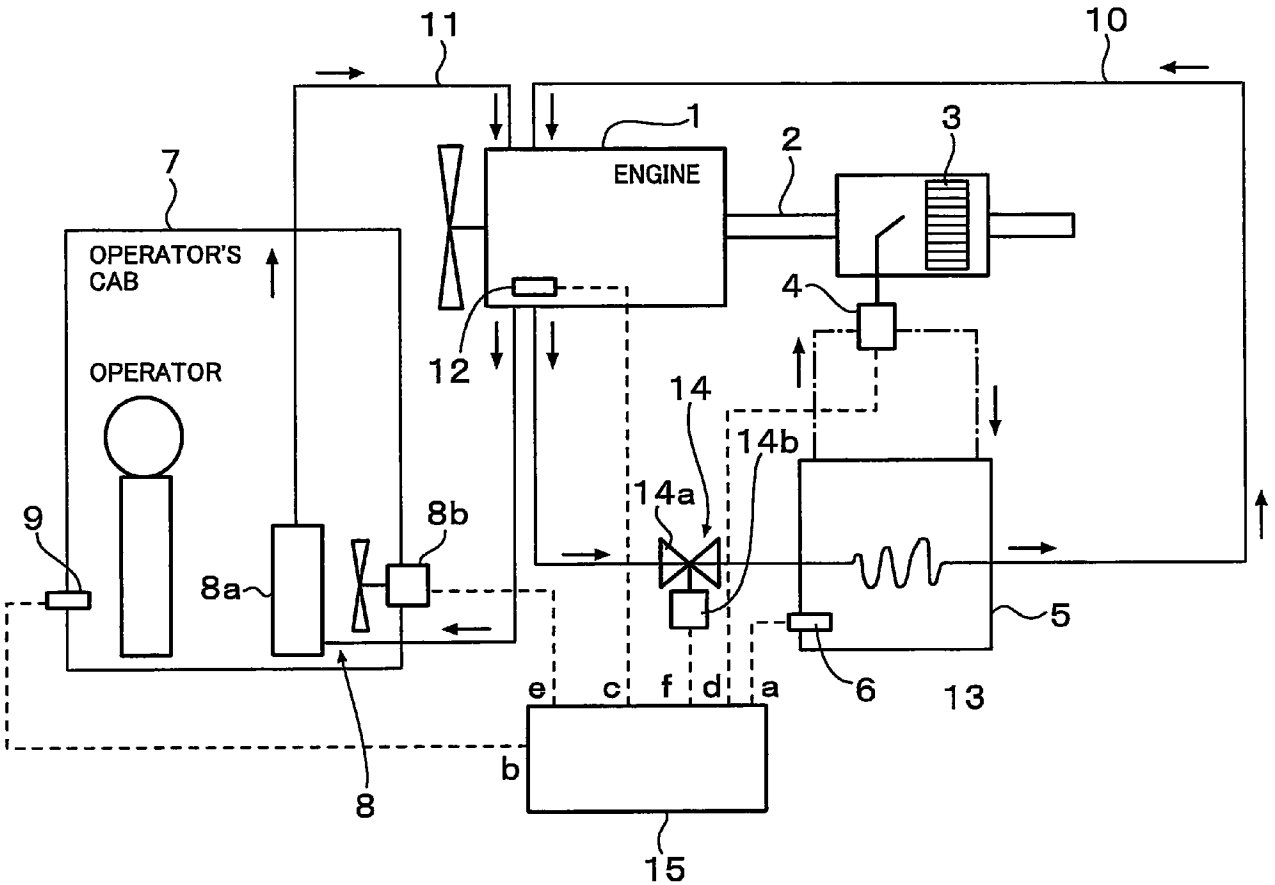
[FIG. 1] A constitution diagram of an engine powered machine according to an embodiment.
Figure 2:
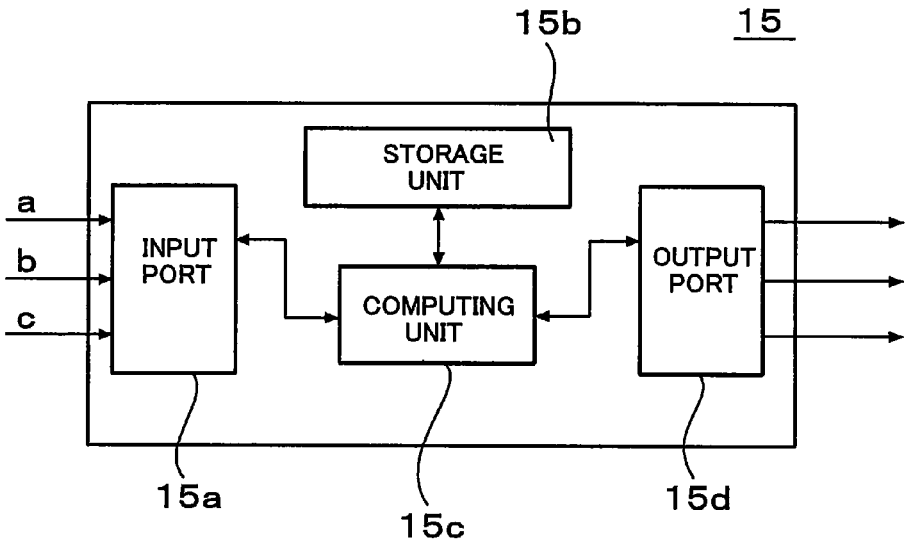
[FIG. 2] A block diagram showing the constitution of a controller in the embodiment.
Figure 3:
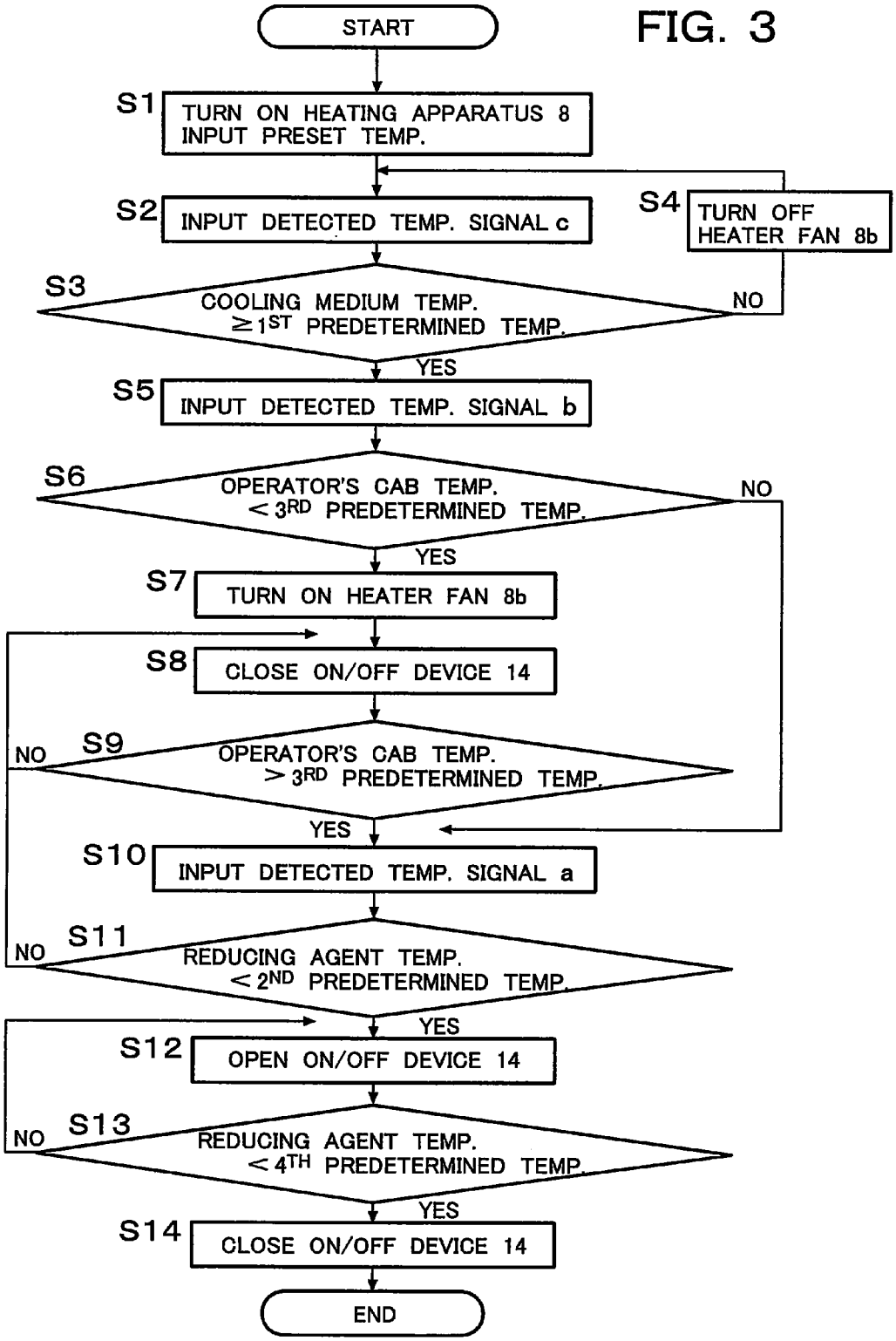
[FIG. 3] A flow chart illustrating a control procedure for a heater fan and on/off device in the embodiment.

One embodiment of the engine powered machine according to the present invention will hereinafter be described based on FIG. 1 to FIG. 3, in which FIG. 1 is a constitution diagram of the engine powered machine according to this embodiment, FIG. 2 is a block diagram showing the constitution of a controller in this embodiment, and FIG. 3 is a flow chart illustrating a control procedure for a heater fan and on/off device in this embodiment.

As depicted in FIG. 1, the engine powered machine of this embodiment is provided with an engine 1 as a power source for individual components of the machine, an NOx removal catalyst 3 arranged in an exhaust pipe (exhaust passage) 2 of the engine 1, a reducing agent feeder 4 for injecting an NOx reducing agent into the exhaust pipe 2 on a side upstream of the arranged location of the NOx removal catalyst 3, a reducing agent tank 5 for storing the reducing agent to be injected by the reducing agent feeder 4, a reducing agent temperature detector 6 for detecting a temperature of the reducing agent stored in the reducing agent tank 5, an operator's cab 7 in which an operator sits to control operation devices for the individual components, including the engine 1, of the machine, a heating apparatus 8 for heating the operator's cab 7, an operator's cab temperature detector 9 for detecting a temperature in the operator's cab 7, a first cooling medium flow passage 10 for guiding a portion of an engine cooling medium to the reducing agent tank 5, a second cooling medium flow passage 11 for guiding a remaining portion of the engine cooling medium to the heating apparatus 8, a cooling medium temperature detector 12 for detecting a temperature of the engine cooling medium flowing through the cooling medium flow passages 10,11, a reducing agent heater 13 for heating the reducing agent, which is stored in the reducing agent tank 5, with heat of the engine cooling medium flowing through the first cooling medium flow passage 10, an on/off device 14 for opening/closing the first cooling medium flow passage 10, and a controller 15 for receiving a detected temperature signal a outputted from the reducing agent temperature detector 6, a detected temperature signal b outputted from the operator's cab temperature detector 9 and a detected temperature signal c outputted from the cooling medium temperature detector 12 and outputting a drive signal d for the reducing agent feeder 4, a drive signal e for the heating apparatus 8 and a drive signal f for the on/off device 14.

As shown in FIG. 2, the controller 15 is comprised of an input port 15*a* for receiving the detected temperature signals a,b,c, a storage unit 15*b* in which first to fourth predetermined temperatures to be described subsequently herein are stored, a computing unit 15*c* for calculating the drive signals d,e,f based on the detected temperature signals a,b,c and the first to third predetermined temperatures, and an output port 15*d* for outputting the drive signals d,e,f, which have been calculated at the computing unit 15*c*, to the reducing agent feeder 4, heating apparatus 8 and on/off device 14, respectively. The first predetermined temperature relates to the temperature of the engine cooling medium, and to avoid blowing out cold air into the operator's cab 7 and giving an unpleasant feel to the operator, is set at a temperature higher than a preset temperature in the operator's cab 7, for example, at +30 degrees when the preset temperature in the operator's cab 7 is +25 degrees. The second and fourth predetermined temperatures relate to the temperature of the reducing agent, the second predetermined temperature is set at the freezing temperature of the reducing agent, for example, at −11° C. when a urea water is used as the reducing agent, and the fourth predetermined temperature is set at a temperature slightly lower than the vaporization temperature of the reducing agent, for example, at a temperature slightly lower than +40° C. at which ammonia is produced, for example, +35° C. when the urea water is used as the reducing agent. Further, the third predetermined temperature relates to the temperature of the operator's cab, and is set at the preset temperature in the operator's cab, for example, +25° C.

The NOx removal catalyst 3, reducing agent feeder 4 and reducing agent tank 5 make up the exhaust gas purification system described in the above-cited Patent Document 1. The reducing agent stored in the reducing agent tank 5, such as a urea water, an aqueous ammonia solution or gas oil containing hydrocarbons as principal components, is injected in the form of a mist into the exhaust pipe 2 by the reducing agent feeder 4, and nitrogen oxides in exhaust gases are selectively subjected to reduction treatment with the reducing agent in the presence of the NOx catalyst to decompose the nitrogen oxides into harmless nitrogen gas and water. When a urea water is used as the reducing agent, the urea water injected into the exhaust pipe 2 is subjected to hydrolysis with the heat of exhaust gases to produce ammonia having good reactivity with nitrogen oxides, and by the thus-produced ammonia, nitrogen oxides are selectively subjected to reduction treatment. Depending on the exhaust rate and exhaust temperature, the injection rate of the reducing agent into the exhaust pipe 2 is controlled to such a range that the nitrogen oxides in exhaust gases can be substantially removed while avoiding leaving the reducing agent as a surplus.

As depicted in FIG. 1, the heating apparatus 8 is comprised of a heat exchange 8*a* with a warm air outlet arranged directing toward the interior of the operator's cab 7, a fan heater 8*b* arranged on a side of a rear wall of the heat exchanger 8*a* as viewed from the side of the operator's cab 7 to blow out warm air into the operator's cab 7, and a heating controller (not depicted) arranged in the operator's cab to permit setting of a temperature, an air volume and the like of the heating apparatus 8.

When the temperature of the engine cooling medium is lower than the first predetermined temperature, the controller 15 does not output the drive signal e to the heater fan 8*b* and maintains the heater fan 8*b* in a stopped state to avoid blowing out cold air into the operator's cab 7 even when the temperature in the operator's cab 7 is lower than the third predetermined temperature. At a stage that the warming-up of the engine has proceeded and the temperature of the engine cooling medium has arisen beyond the first predetermined temperature, the drive signal e is outputted under the premise that the temperature in the operator's cab 7 is lower than the third predetermined temperature. Warm air is, therefore, delivered into the operator's cab 7 until the temperature in the operator's cab 7 reaches a value set by manipulating the undepicted heating controller.

As depicted in FIG. 1, the on/off device 14 is comprised of a valve element 14*a* for opening or closing the first engine cooling medium flow passage 10 and an actuator 14*b*, such as a solenoid, for driving the valve element, and the switched position of the valve element 14*a* is controlled by the drive signal f outputted from the controller 15. The total amount of the engine cooling medium flowing through the first engine cooling medium flow passage 10 and second engine cooling medium flow passage 11 is always constant. When the on/off valve 14 arranged on the first engine cooling medium flow passage 10 is closed, the flow rate of the engine cooling medium that flows through the second engine cooling medium flow passage 11 can, therefore, be increased by as much as the flow rate at which the engine cooling medium flows through the first engine cooling medium flow passage 10 during the opening of the on/off device 14, thereby making it possible to promptly heat the interior of the operator's cab 7.

When the temperature of the engine cooling medium as detected by the cooling medium temperature detector 12 is higher than the first predetermined temperature and the temperature in the operator's cab 7 as detected by the operator's cab temperature detector 9 is lower than the third predetermined temperature, the controller 15, even when the temperature of the reducing agent as detected by the reducing agent temperature detector 6 is lower than the second predetermined temperature, outputs a drive signal f to switch the on/off device 14 into the closed state so that the introduction of the engine cooling medium into the reducing agent heater 13 is cut off to increase the flow rate of the engine cooling medium to be guided to the heat exchanger 8*a* of the heating apparatus 8. As a consequence, the operator's cab 7 can be preferentially heated at a cold time, and therefore, the operator's comfort can be improved. After the temperature in the operator's cab 7 has reached the third predetermined temperature, the controller 15 outputs a drive signal f to switch the on/off device 14 into the open state so that the engine cooling medium is introduced into the reducing agent heater 13 to heat the reducing agent, which is stored in the reducing agent tank 5, to the fourth predetermined temperature.

It is to be noted that, even when the temperature of the engine cooling medium is lower than the first predetermined temperature and the heater fan 8*b* is hence maintained in the stopped state, the controller 15 maintains the on/off device 14 in the open state to achieve heating of the reducing agent stored in the reducing agent tank 5 when the temperature of the reducing agent is lower than the fourth predetermined temperature. When the temperature in the operator's cab 7 has reached the third predetermined temperature and the temperature of the reducing agent is higher than the second predetermined temperature but is lower than the fourth predetermined temperature set at a temperature higher than the second predetermined temperature, on the other hand, the controller 15 maintains the on/off device 14 in the open state to heat the reducing agent stored in the reducing agent tank 5. As a consequence, it is possible to maintain the reducing agent, which is stored in the reducing agent tank 5, within an appropriate temperature range higher than its freezing temperature but lower than its vaporization temperature, and therefore, to perform the reduction treatment of the exhaust gases with high efficiency. When the temperature of the reducing agent has reached the fourth predetermined temperature, the controller 15 switches the on/off device 14 into the closed state to avoid heating of the reducing agent, which is stored in the reducing agent tank 5, any further. As a consequence, it is possible to avoid the production of an offensive odor from the reducing agent.

With reference to FIG. 3, a description will hereinafter be made of a control procedure for the heater fan 8*b* and on/off device 14 by the controller 15 in this embodiment.

When the engine 1 is started up, the control 15 is waked up as a result, and control of the heater fan 8*b* and open/close device 14 by the controller 15 starts. When an operator manipulates the undepicted heating controller arranged in the operator's cab after the start-up of the engine to turn on the heating apparatus 8 and to input a presetting temperature for the heating apparatus 8 (step S1), drive control of the heater fan 8*b* will then be performed in accordance with the preset temperature value. It is to be noted that this step S1 can be skipped when the heating apparatus 8 has already been switched into ON operation upon start-up of the engine and the presetting temperature for the heating apparatus 8 is not changed.

After the routine next moves to step S2 to input the detected temperature signal c from the cooling medium temperature detector 12, the routine moves to step S3 to determine whether or not the temperature of the engine cooling medium flowing through the cooling medium flow passages 10,11 has reached the first predetermined temperature. When the temperature of the engine cooling medium is not determined to have reached the first predetermined temperature in step S3, the routine moves to step S4 to maintain or switch the heater fan 8*b* in or into an OFF state and then returns to step S2. As a consequence, a blowout of cold air into the operator's cab 7 is prevented. When the temperature of the engine cooling medium is determined to have reached the first predetermined temperature in step S3, on the other hand, the routine moves to step S5. After the detected temperature signal b from the operator's cab temperature detector 9 is inputted, the routine moves to step S6 to determine whether or not the temperature in the operator's cab 7 is lower than the third predetermined temperature. When the temperature in the operator's cab 7 is determined to be lower than the third predetermined temperature in step S6, the routine moves to step S7 to switch the fan heater 8*b* into a driven state. Subsequently, the routine moves to step S8 to switch the on/off device 14 into the closed state.

The routine next moves to step S9 to determine whether or not the temperature in the operator's cab 7 has reached the third predetermined temperature. When the temperature in the operator's cab 7 is determined to have reached the third predetermined temperature in step S9, the routine moves to step S10 to input the detected temperature signal a from the reducing agent temperature detector 6. Subsequently, the routine moves to step S11 to determine whether or not the temperature of the reducing agent stored in the reducing agent tank 5 is lower than the second predetermined temperature. When the temperature of the reducing agent is determined to be lower than the second predetermined temperature in step S11, the routine moves to step S12 to switch the on/off device 14 into the open state, so that the engine cooling medium is introduced into the reducing agent heater 13 via the first cooling medium flow passage 10 to heat the reducing agent, which is stored in the reducing agent tank 5, with the heat of the engine cooling medium. It is to be noted that, when the temperature in the operator's cab 7 is determined to have reached the third predetermined temperature in step S6, the routine moves to step S10. Further, when the temperature in the operator's cab 7 is not determined to have reached the third predetermined temperature in step S9 or the temperature of the reducing agent stored in the reducing agent tank 5 is determined to be higher than the second predetermined temperature in step S11, the routine returns to step S8 to maintain the on/off device 14 in the closed state. As a consequence, the reducing agent which has been in a frozen state can be thawed, thereby making it possible to inject the reducing agent into the exhaust pipe 2 by the reducing agent feeder 4.

Subsequently, the routine moves to step S13 to determine whether or not the temperature of the reducing agent stored in the reducing agent tank 5 has reached the fourth predetermined temperature. When the temperature of the reducing agent is determined to have reached the fourth predetermined temperature in step S13, the routine moves to step S14 to switch the on/off device 14 into the closed state. When the temperature of the reducing agent is not determined to have reached the fourth predetermined temperature in step S13, the routine returns to step S12 to maintain the on/off device 14 in the open state. As a consequence, the reducing agent can be heated to the predetermined temperature while achieving the prevention of vaporization of the reducing agent and hence, production of an offensive odor.

Legend

1 Engine
2 Exhaust pipe
3 NOx removal catalyst
4 Reducing agent feeder
5 Reducing agent tank
6 Reducing agent temperature detector
7 Operator's cab
8 Heating apparatus
9 Operator's cab temperature detector
10 First engine cooling medium flow passage
11 Second engine cooling medium flow passage
12 Cooling medium temperature detector
13 Reducing agent heater
14 On/off device
15 Controller

The invention claimed is:

1. An engine powered machine comprising:

a NOx removal catalyst arranged in an exhaust passage of an engine to selectively subject to reduction treatment nitrogen oxides that flow through the exhaust passage, a reducing agent tank for storing a reducing agent, a reducing agent feeder for injecting into the exhaust passage the reducing agent stored in the reducing agent tank, a reducing agent temperature detector for detecting a temperature of the reducing agent stored in the reducing agent tank, a reducing agent heater for heating the reducing agent, which is stored in the reducing agent tank, with heat of an engine cooling medium, a valve device for opening/closing a cooling medium flow passage that guides the engine cooling medium to the reducing agent heater, a cooling medium temperature detector for detecting a temperature of the engine cooling medium, a heating apparatus for heating an interior of an operator's cab with heat of the engine cooling medium, an operator's cab temperature detector for detecting a temperature in the operator's cab, and a controller for receiving detected temperature signals outputted from the respective temperature detectors and controlling drive of the reducing agent feeder, valve device and heating apparatus, wherein:

the controller is operatively configured to signal the valve device into a closed state to cut off an introduction of the engine cooling medium into the reducing agent heater to increase a flow rate of the engine cooling medium to be guided to the heating apparatus substantially when: i) the temperature of the engine cooling medium as detected by the cooling medium temperature detector is higher than a first predetermined temperature that is higher than a preset temperature of the heating apparatus in the interior of the operator's cab, so as to avoid blowing out cold air into the operator's cab and giving an unpleasant feel to the operator, ii) the temperature of the reducing agent as detected by the reducing agent temperature detector is lower than a second predetermined temperature that freezes the reducing agent, and iii) the temperature in the operator's cab as detected by the operator's cab temperature detector is lower than a third predetermined temperature that is the preset temperature of the heating apparatus in the interior of the operator's cab;

the controller is further operatively configured to signal the valve device into an open state so that the engine cooling medium is introduced into the reducing agent heater, in a case a temperature of the reducing agent detected by the reducing agent temperature detector is lower than said second predetermined temperature that freezes the reducing agent after the temperature in the interior of the operator's cab has reached the third predetermined temperature; and even when a temperature of the engine cooling medium is lower than the first predetermined temperature and a heater fan is prevented from turning on, the controller is operatively configured to signal the valve into the open state to achieve heating of the reducing agent stored in the reducing agent tank, substantially when the temperature of the reducing agent is lower than a fourth predetermined temperature, which is set at a temperature slightly lower than a vaporization temperature of the reducing agent.

* * * * *